United States Patent [19]

Suzuki et al.

[11] Patent Number: 4,861,702

[45] Date of Patent: Aug. 29, 1989

[54] RAPIDLY PROCESSING SILVER HALIDE PHOTOGRAPHIC LIGHT-SENSITIVE MATERIAL AND THE PROCESSING THEREOF

[75] Inventors: Akio Suzuki; Eiji Yoshida, both of Hachioji; Satoru Nagasaki; Masumi Arai, both of Hino; Nobuaki Tsuji, Hachioji, all of Japan

[73] Assignee: Konica Corporation, Tokyo, Japan

[21] Appl. No.: 296,327

[22] Filed: Jan. 11, 1989

Related U.S. Application Data

[63] Continuation of Ser. No. 130,107, Dec. 7, 1987, abandoned.

[30] Foreign Application Priority Data

Dec. 8, 1986 [JP] Japan ..... 61-291939

[51] Int. Cl.[4] ..... G03C 1/02; G03C 5/24; G03C 5/38

[52] U.S. Cl. ..... 430/564; 430/420; 430/494; 430/559; 430/567; 430/621; 430/642; 430/966; 430/967

[58] Field of Search ..... 430/420, 494, 559, 567, 430/621, 642, 966, 967, 564

[56] References Cited

U.S. PATENT DOCUMENTS

| | | | |
|---|---|---|---|
| Re. 26,601 | 6/1969 | Allen et al. | 430/966 |
| 3,467,519 | 9/1969 | Frank | 430/966 |
| 3,545,971 | 12/1970 | Barnes et al. | 96/61 |
| 3,671,256 | 6/1972 | Minsk et al. | 430/625 |
| 4,046,571 | 9/1977 | Mertz | 430/960 |
| 4,177,071 | 12/1979 | De Brabandere et al. | 430/494 |
| 4,414,304 | 11/1983 | Dickerson | 430/353 |
| 4,564,588 | 1/1986 | Sakamoto et al. | 430/967 |
| 4,585,729 | 4/1986 | Sugimoto et al. | 430/502 |
| 4,609,621 | 9/1986 | Sugimoto et al. | 430/966 |
| 4,672,025 | 6/1987 | Yamada et al. | 430/420 |
| 4,731,322 | 3/1988 | Suzuki et al. | 430/567 |

FOREIGN PATENT DOCUMENTS 65233 of 1986 Japan .

*Primary Examiner*—Mukund J. Shah

*Attorney, Agent, or Firm*—Finnegan, Henderson, Farabow, Garrett & Dunner

[57] ABSTRACT

A silver halide photographic light-sensitive material and a process for processing it are disclosed. The light-sensitive material is improved in photographic sensitivity, drying property and anti-roller-mark property and is suitable for the disclosed ultra-rapid processing by an automatic processor in which the photographic material is processed for the time of 20 sec to 60 sec in total. The light-sensitive material comprises a support having on at least one side thereof one or more hydrophilic layers containing gelatin which comprise at least one light-sensitive silver halide emulsion layer. An amount of the gelatin contained in said hydrophilic layer or layers is within the range of from 1.90 to 3.50 g/m$^2$ and a swelling amount of said hydrophilic layer or layers is within the range of from 30 to 58 g/m$^2$ when said light-sensitive material is treated in a specific condition for 15 sec. at 35° C.

24 Claims, 1 Drawing Sheet

RAPIDLY PROCESSING SILVER HALIDE PHOTOGRAPHIC LIGHT-SENSITIVE MATERIAL AND THE PROCESSING THEREOF

This application is a continuation of application Ser. No. 07/130,107, filed Dec. 7, 1987, now abandoned.

FIELD OF THE INVENTION

This invention relates to a silver halide photographic light-sensitive material and the processing thereof and, particularly, to a rapidly processable silver halide photographic light-sensitive material which is excellent in both sensitivity and drying property and is also relatively less in roller-mark trouble, and the processing thereof.

BACKGROUND OF THE INVENTION

In recent years, the consumption of silver halide photographic light-sensitive materials is getting increased year by year. Accordingly, the numbers of processing silver halide photographic light-sensitive materials are also getting increased. It has therefore been demanded to make the processing thereof more rapid, that is, to increase the processing quantity thereof within the same period of processing time.

The above-mentioned tendency is also found in the field of X-ray sensitive products such as medical X-ray films. For example, as the frequency of diagnoses are being increased in the popularization of periodic physical examinations and so forth, inspection items are also increased to make diagnoses more accurate and, accordingly, X-ray photographs are further increased.

On the other hand, it is also required to let every examinee know the results of the examination as soon as possible.

In other words, it is strongly demanded that X-ray photographs should be processed more quickly than before so as to diagnose properly and without delay. Particularly in angiography, X-ray photography in operation and so forth, it is required intrinsically that an X-ray photograph is no sooner processed than it can be seen.

To satisfy the above-mentioned demands of medical circles, it is required to process X-ray films more rapidly, as well as to expedite the automation of diagnoses (such as X-ray photographing, transporting and so forth).

When a super-rapid processing is carried out, however, there may cause the following problems: (a) Density may not satisfactorily be obtained, (Sensitivity, contrast and maximum density may be deteriorated); (b) Fixing may not satisfactorily be performed; (c) Films may not satisfactorily be washed; and so forth.

In medical X-ray films, the silver halide having a blue-black tone are preferable from the viewpoint of making diagnoses easier, and the blue-black tone is required to keep longer when it is stored for a long time. In a rapid process, however, there is a fear of changing the tone of a silver image into sepia tone, because the fixing may not satisfactorily be performed. [see the above-mentioned (d)].

One solution of the above-mentioned problems is to reduce a gelatin content. In particular, the drying property [i.e., the above-mentioned (d)] may be improved thereby. On the other hand, however, if the gelatin content is reduced, such a trouble as coating mottles, coating streaks or the like is apt to cause, when coating a silver halide light-sensitive material. Besides, if films have a relatively less gelatin content and when they are scratched with each other or with other substances, there may be a trouble that the density of the scratched portions may be darkened more than in other portions, that is, the so-called black-abrasion mark is apt to cause. If films have a relatively less gelatin content and when using an automatic processor, the roller of the processor may sometimes leave its traces on the films, that is, the so-called roller-mark may be left thereon.

Further, in a rapid processing, the sensitivity of silver halide grains and the rate of development are required to be raised, because the density is not enough as mentioned in Item (a). This also cause the above-mentioned roller-mark easier.

As mentioned above, the super-rapid processing has been desired. The super-rapid processing mentioned in this specification means that a processing takes 20 seconds to 60 seconds in a total time, [in other words, a quotient (sec) divided a full length (meter) by a line-transport speed (meter/sec)], from a time when the leading edge of a film is inserted into an automatic processor to a time when the leading edge of the film is delivered from a drying section after the film was passed through a developing tank, a cross-over section, a fixing tank and the drying section.

In Japanese Patent Examined Publication No. 47045-1976, there is a description that a gelatin content is an essential factor for rapid processing and a total processing time including a time required for passing through a cross-over section is from 60 seconds to 120 seconds. This processing time cannot satisfy the requirements for the recent super-rapid processing.

On the other hand, the swelling degree of films in a developer is an essential factor for solving the above-mentioned problems caused in the films having a low gelatin content. The technologies concerning these problems are described in, for example, Japanese Patent O.P.I. Publication Nos. 111933-1983 and 65233-1986.

In the technology described in Japanese Patent O.P.I. Publication No. 11933-1983, such gelatin content is not less than 3.75 g/m$^2$ that cannot be expected to perform any rapid processing. In Japanese Patent O.P.I. Publication No. 65233-1986, there is a description of the gelatin contents of emulsion layers, but is neither description of the gelatin content of a protective layer arranged onto the emulsion layers nor that of any processing time. In addition to the above, the technologies described in both Japanese Patent O.P.I. Publication Nos. 11933-1983 and 65233-1986 cannot solve the above-mentioned problems with satisfying a rapid processing, because the developers used in the examples of those inventions were removed therefrom glutaraldehyde that greatly influence the swelling degrees of films.

SUMMARY OF THE INVENTION

Figure 1:
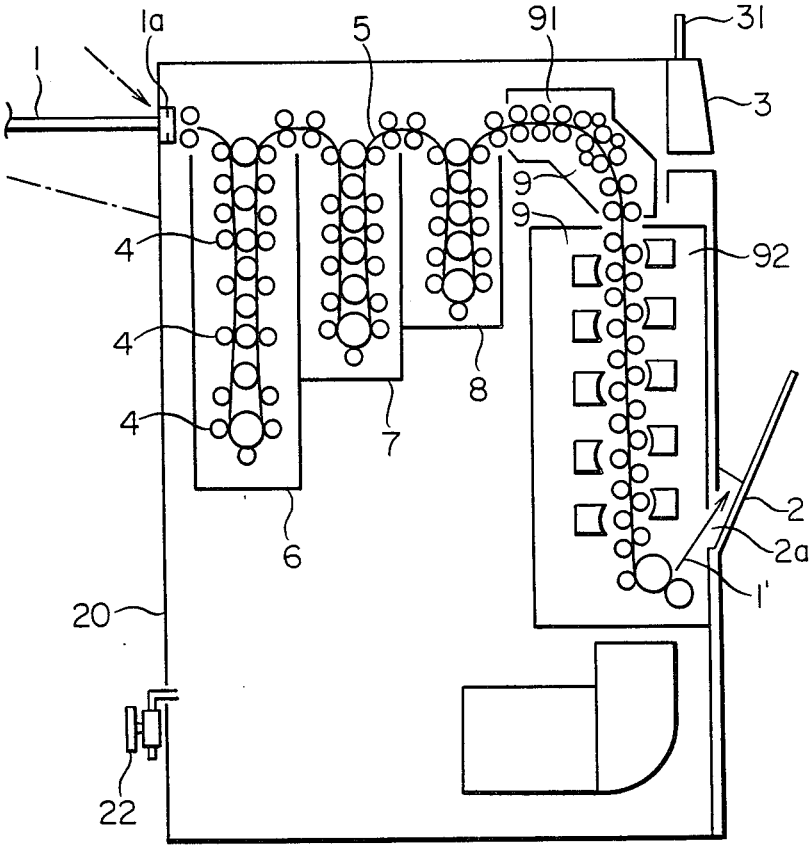
FIG. 1 shows a constitutional illustration of an example of automatic processing appratuses which can be used for processing the light-sensitive materials of the invention.

It is an object of the invention to provide a silver halide photographic light-sensitive material which is excellent in sensitivity and drying property and substantially less in occurrence of roller-marks, even if the gelatin content thereof is reduced to the lowest a super-rapid processing can be performed within a total processing time of from 20 to 60 seconds.

The object of the invention can be achieved with a silver halide photographic light-sensitive material comprising a support bearing thereon one or more gelatin-containing hydrophilic colloidal layers including at least one light-sensitive silver halide emulsion layer, wherein the gelatin contents of the hydrophilic colloidal layers are within the range of from 1.90 to 3.5 g/m$^2$, and the swelling degree is within the range of from 30 to 58 g/m$^2$ when processing with the following developer-I at 35° C. for 15 seconds.

| Developer-1 | |
|---|---|
| Potassium sulfite | 55.0 g |
| Hydroquinone | 25.0 g |
| 1-phenyl-3-pyrazolidone | 1.2 g |
| Boric acid | 10.0 g |
| Potassium hydroxide | 21.0 g |
| Triethylene glycol | 17.5 g |
| 5-methylbenztriazole | 0.05 g |
| 5-nitrobenzimidazole | 0.10 g |
| 1-phenyl-5-mercaptotetrazole | 0.02 g |
| Glutaraldehyde bisulfite | 15.0 g |
| Glacial acetic acid | 16.0 g |
| Potassium bromide | 4.0 g |
| Water to make | 1 liter |

In the preferable embodiments of the invention, the silver halide photographic light-sensitive materials of the invention are to be processed with an automatic processor of which a total processing time is within the range of from 20 to 60 seconds.

DETAILED DESCRIPTION OF THE INVENTION

Now, the invention will be explained in detail.

The silver halide photographic light-sensitive materials of the invention each are comprised of a support bearing on one side thereof one or more gelatin-containing hydrophilic colloidal layers including at least one light-sensitive silver halide emulsion layer.

The silver halide grains contained in a photographic emulsions used in the invention may be regularly crystallized, irregularly crystallized or crystallized compoundwise. The grains may also be a mixture of variously crystallized grains.

For embodying the invention, the silver halide grains used in the silver halide emulsion of the invention may be prepared in any of ordinary methods such as a neutral method, an acid method, an ammonia method, a normal precipitation method, a reverse precipitation method, a double-jet method, a controlled double-jet method, a conversion method, a core/shell method, and so forth.

The silver halide emulsion used in the invention may optionally be chemically sensitized, and may also be spectrally sensitized with a methine dye or others.

The silver halide emulsion used in the invention may further be added with any compounds which have been well-known as an antifogging agent or a stabilizer.

As for the binders or protective colloids added in the emulsion layers and interlayers of the light-sensitive materials of the invention, gelatins are used, and the other hydrophilic colloids may also be used freely together with the gelatins.

A gelatin content of the hydrophilic colloidal layers used in the invention is within the range of from 1.90 to 3.50 g/m$^2$ and, preferably, from 2.00 to 3.30 g/m$^2$.

When processing the silver halide photographic light-sensitive materials of the invention with the above-mentioned developer-I at 35° C. for 15 seconds, the swelling degree thereof is within the range of from 30 to 58 g/m$^2$, preferably, from 35 to 55 g/m$^2$ and, more preferably, from 40 to 51 g/m$^2$.

In the invention, the term, swelling degree, is defined as follows:

(a) A photographic light-sensitive material of 30.5×25.4 cm in size, which was exposed to as much light as to give its maximum density if it was processed, is allowed to stand for 5 hours at 23° C. and 55% RH;

(b) The weight of the light-sensitive material is measure;

(c) The light-sensitive material is dipped into the above-mentioned developer-I being kept at 35° C., for 15 seconds at 35° C., and is taken it out from the developer. While holding the light-sensitive material by one of the corners thereof for 30 seconds, the developer remaining thereon is fallen off from the light-sensitive material;

(d) The weight is measured;

(e) The increased weight is obtained by comparing the weight (b) to the weight (d).

The procedure of from (a) through (e) is repeated three time to obtain the average value of the increased weight.

A swelling degree is determined by converting the above-mentioned average value into a value per square meter. The conversion may be given by the following equation:

$$\text{Swelling degree (g/m}^2) = \frac{\text{Weight increased (g)}}{(0.305 \times 0.254 \text{ sq. m})}$$

In the invention, any of the well-known hardeners may be used independently or in combination with the purpose of obtaining a swelling degree within the above-mentioned range. The amount thereof added is varied according to the kinds of the hardeners and, therefore, a person skilled in the art may be able to select an amount added suitably so as to meet his desired swelling degree.

Namely, the hardeners which may be used include, for example, a chromium salt such as chrome alum, chromium acetate and so forth; an aldehyde such as formaldehyde, glyoxal, glutaraldehyde and so forth; an N-methylol compound such as dimethylolurea, methylol dimethylhydantoine and so forth; a dioxane derivative such as 2,3-dihydroxydioxane and so forth; an active vinyl compound such as 1,3,5-triacryloyl-hexahydro-2-triazine, 1,3-vinylsulfonyl-2-propanol and so forth; an active halogen compound such as 2,4-dichloro-6-hydroxy-3-triazine and so forth; and a mucohalogeno acid such as mucochloric acid, mucophenoxychloric acid and so forth.

The typical examples of such hardeners will be given below and it is, however, to be understood that the invention shall not be limited thereto.

Typical examples of hardeners:

$$\text{HCHO} \quad (1)$$

$$\begin{array}{c}\text{CHO}\\ |\\ \text{CHO}\end{array} \quad (2)$$

$$\text{CH}_3\text{CHO} \quad (3)$$

-continued (4)

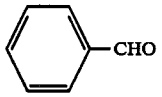

(5) $OHC{-}(CH_2)_3{-}CHO$ (6) $ClCH_2CONHCOCH_2Cl$ (7) $ClCH_2COOCH_2CH_2OOCCH_2Cl$ (8)

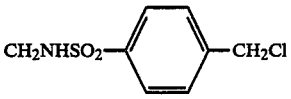

(9) $CH_3COCl$

(10) $CH_3COCH_2Cl$ (11)

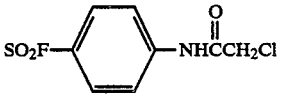

(12)

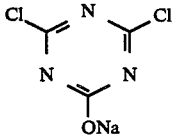

(13)

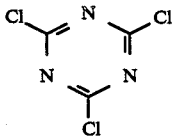

(14)

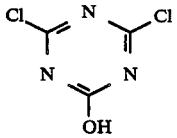

(15)

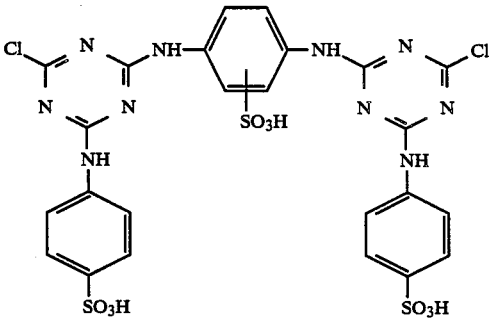

(16) $CH_2{=}CHSO_2(CH_2)_3SO_2CH{=}CH_2$ (17)

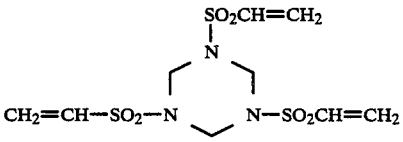

(18) $C(CH_2SO_2CH{=}CH_2)_4$

-continued (19)

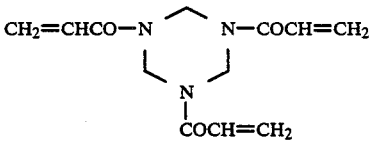

(20) $CH_2{=}CHCOOCOCH{=}CH_2$

(21) $CH_2{=}CH{-}O{-}CH{=}CH_2$ (22)

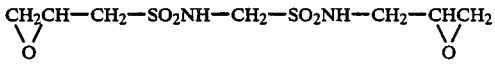

(23)

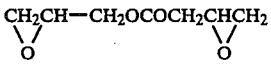

(24)

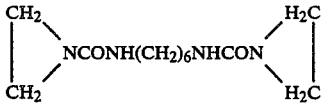

(25)

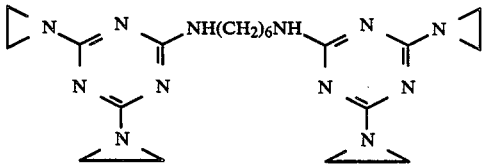

(26)

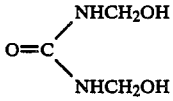

(27)

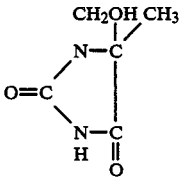

(28)

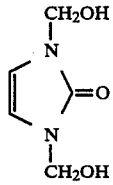

(29)

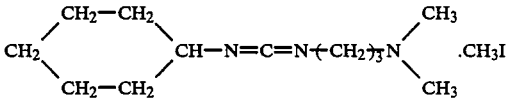

(30)

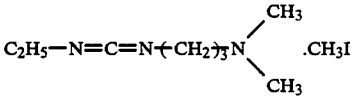

(31) $CH_2{=}CHCONHCOCH{=}CH_2$

In the invention, it is also allowed to use the hardeners disclosed in Japanese Patent O.P.I. Publication Nos. 112034-1985 and 61742-1985. For example, it is allowed to use the polymers each having a functional group capable of making a cross-linking reaction with gelatin through a hardener, of which disclosed in, for example, U.S. Pat. No. 4,207,109.

Further, the macromolecular hardeners each having a functional group capable of reacting with gelatin, of which described in, for example, Japanese Patent O.P.I. Publication No. 66841-1981; British Patent No. 1,322,971; U.S. Pat. No. 3,671,256; D. M. Burness, J. Puradler, 'The Theory of the Photographic Process', 4th Ed., (T. H. James ed.), Macmillan, N.Y., 1977, pp. 84-; G. A. Campbell, L. R. Hamilton, I. S. Poaticeilo, 'Polymeric Amine and Ammonium Salts', (E. J. Goethals ed.), Pergamon Press, N.Y., 1979, pp. 321-332; and so forth.

The macromolecular hardeners preferably used include, for example, a dialdehyde starch; a polyacrolein; a polymer having an aldehyde group such as an acrolein copolymer described in U.S. Pat. No. 3,396,029; a polymer having an epoxy group described in U.S. Par. No. 3,623,875; a polymer having a dichlorotriazine group described in U.S. Pat. No. 3,362,827, Research Disclosure, No. 17333, 1978, and so forth; a polymer having an active ester group described in Japanese Patent O.P.I. Publication No. 66841-1981; and a polymer having an active vinyl group or a group being the precursor of the active vinyl group, described in Japanese Patent O.P.I. Publication Nos. 142524-1981 and 65033-1979, U.S. Pat. No. 4,161,407, Research Disclosure No. 16725, 1978 and so forth. Among the above preferable hardeners, the particularly preferable hardeners include, for example, a polymer of which the principal chain is bonded to an active vinyl group or a group being the precursor of the active vinyl group through a long spacer, described in Japanese Patent O.P.I. Publication No. 142524-1981.

In the light-sensitive silver halide emulsions used in the light-sensitive materials of the invention, the average grain size of the silver halide grains used in the emulsions is not less than 0.4 μm and, preferably, from 0.45 μm to 2.5 μm. In the invention, the term, average grain size, means a grain diameter in the case of globular-shaped silver halide grains, or an average value of the diameter of a circle image having the same area as that of the projective image of each grain in the case of cubic or other shaped grains than the globular-shaped ones. In the case that an individual grain size is ri, and the number thereof is ni, an average grains size r will be defined by the following equation:

$$r = \frac{\Sigma niri}{\Sigma ni}$$

In the invention, the silver content of the silver halide emulsion layers each coated at least one side of the support is less than 3.2 g/m$^2$ (on the one side of the support) and, more preferably, from 3.0 g/m$^2$ to 1.2 g/m$^2$.

At least one layer constituting a silver halide photographic light-sensitive material of the invention contains a nonionic surface active agent.

As for the nonionic surface active agents used in the invention, it is preferable to use the compounds described in Japanese Patent O.P.I. Publication No. 76741-1985, pp. 267-273. Among the preferable compounds, the particularly preferable ones are the compounds given below or the like compounds including those used in the undermentioned examples.

Nonionic surface active agents $C_{11}H_{23}COO(CH_2CH_2O)_{10}H$ 1.

-continued $C_{12}H_{25}(CH_2CH_2I)_9H$ 2.

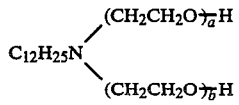
3.

a + b = 20

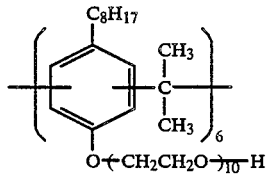
4.

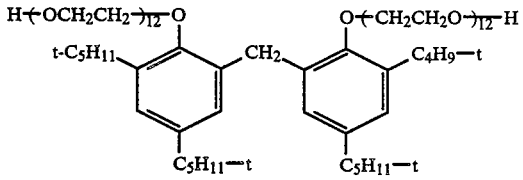
5.

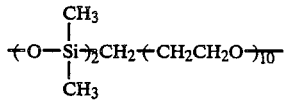
6.

$C_{10}F_{21}(CH_2CH_2O)_{23}C_{10}F_{21}$ 7.

$C_{12}F_{25}CH_2CH_2O(CH_2CH_2O)_{15}H$ 8.

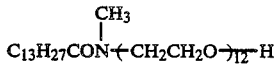
9.

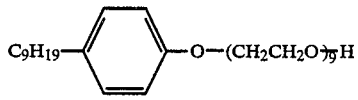
10.

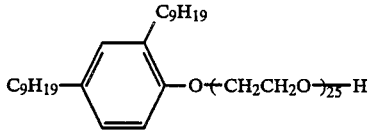
11.

$HO(CH_2CH_2O)_{10}(CH_2CH_2-O)_{30}(CH_2CH_2O)_{25}H$ 12.

The amount of the nonionic surface active agents used in the invention is, generally, within the range of from 1 to 500 mg per m$^2$ of a photographic light-sensitive material used and, preferably, from 3 to 150 mg.

It is preferred that the silver halide grains, which are contained in at least one light-sensitive silver halide emulsion layer constituting a light-sensitive material of the invention, have an iodide content of not more than 5 mol %, and that the iodide content of the grain surface is not more than 0.5 mol %.

The above-mentioned iodide content is within the range of, preferably, from 0.2 to 4 mol %, more preferably, from 0.5 to 4 mol % and, particularly, from 1.0 to 4 mol %.

Such iodide content can be measured in such a method as described in Society of Photographic Science and Technology of Japan. The Elements of Photographic Engineering - Silver Photography, Corona Publishing Co., p. 279.

The iodide content of the grain surface is preferably not more than 0.4 mol %.

The iodide content of silver halide grains from the surface down to 50 Å in depth may be measured in a method of electron spectroscopy for chemical analysis (ESCA) by making use of Mg.Kα rays and an apparatus, Perkin-Elmer Model PHI-560. In this specification of the invention, the term, an iodide content of silver grain surface, means on iodide content of 50 Å in depth.

It is preferred to contain a dyestuff into at least one layer constituting a light-sensitive material of the invention.

For example, it is allowed to use a dyestuff having a maximum absorption wavelength of from 520 to 580 nm, which is capable of still remaining in the layer containing it even after completing a processing. In this case, it is advisable that such a dyestuff has a maximum absorption wavelength of preferably from 530 to 570 nm and more preferably from 540 to 560 nm. Such dyestuffs include, for example, an anthraquinone dye, an azo dye, an azomethine dye, an oxonol dye, a carbocyanine dye, a styryl dye and so forth. From the viewpoint of color fastness against fading by light, it is preferable to use the anthraquinone dyes, azo dyes or azomethine dyes. They include, for example the following dyes:

No. 1

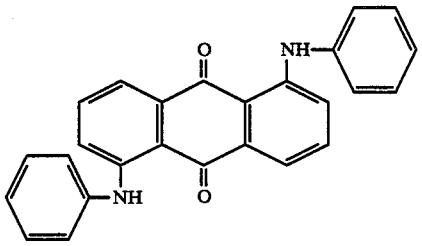

No. 2

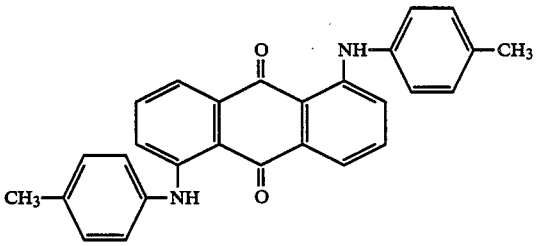

No. 3

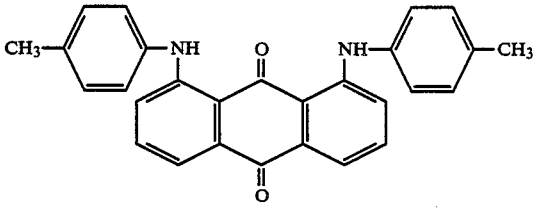

No. 4

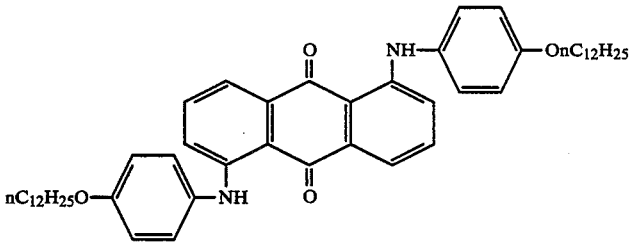

No. 5

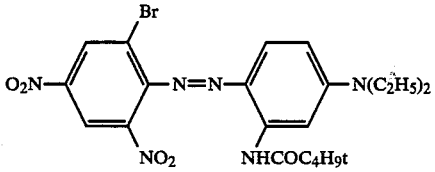

-continued
No. 6
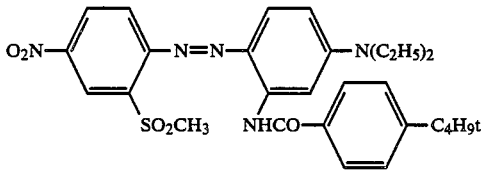
No. 7
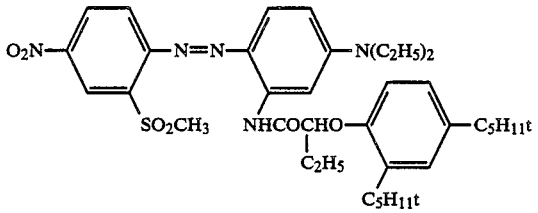
No. 8
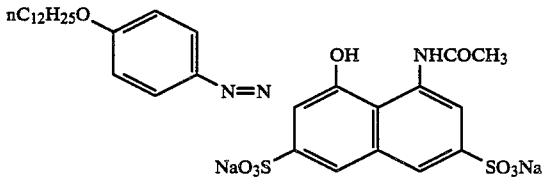
No. 9
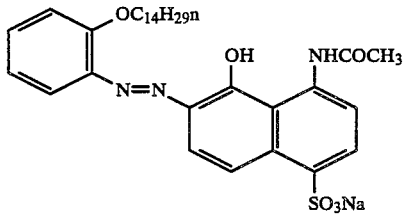
No. 10
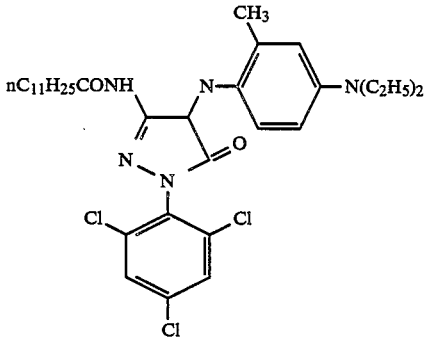
No. 11
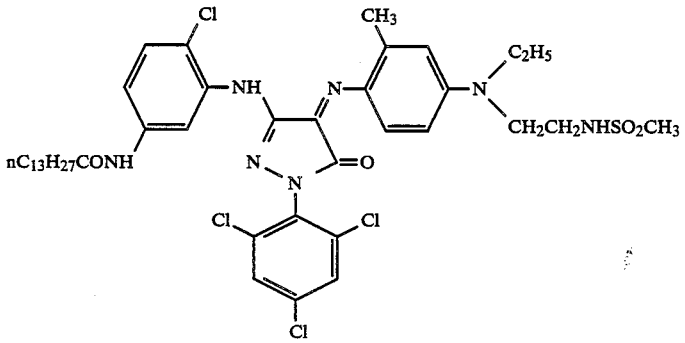

-continued

No. 12

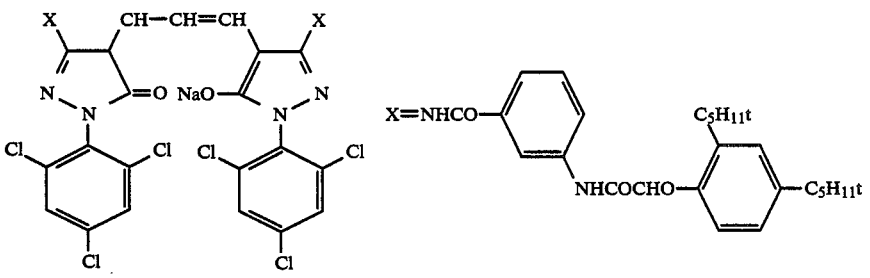

No. 13

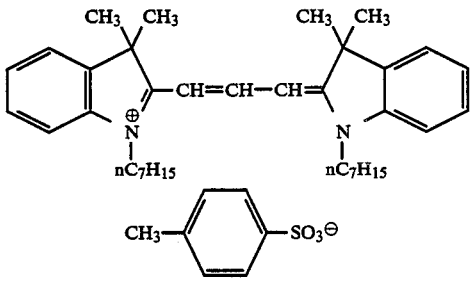

No. 14

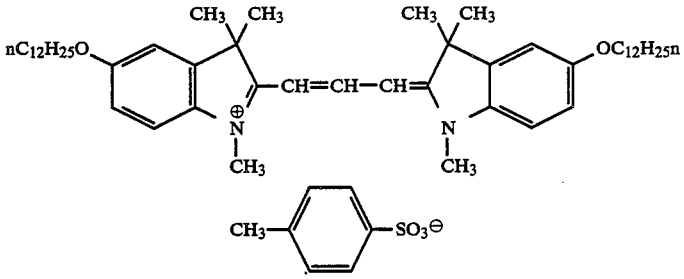

No. 15

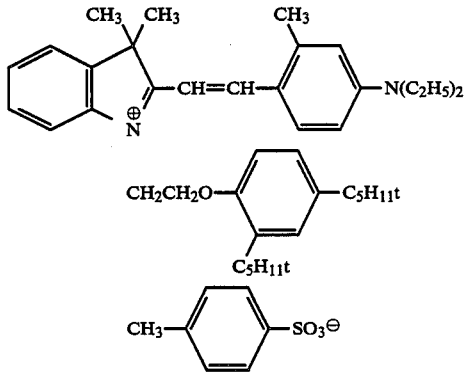

The above-given dyestuffs may be added into emulsion layers and other hydrophilic colloidal layers such as an interlayer, a protective layer, an antihalation layer, a filter layer and so forth, in any of various methods. Such dyestuffs may be dissolved or dispersed directly to an emulsion layer and so forth, or they may also be added thereto either in the form of an aqueous solution or after they are dissolved to disperse into a solvent. Such solvents include, for example, various types of lower alcohols, methyl cellosolve, a halogenated alcohol, acetone, water, pyridine and so forth, and the mixtures thereof. They may also be added in the form of a solution, into an emulsion. It is further allowed that they are dissolved in a substantially water-soluble high boiling solvent having a melting point of about not lower than 160° C. and the resulting solution is added to a hydrophilic colloidal solution and are then dispersed therein.

Such high boiling solvents include, for example, alkyl esters of phthalic acid, such as dibutyl phthalate, dioctyl phthalate and so forth; phosphoric acid esters such as diphenyl phosphate, triphenyl phosphate, tricresyl phosphate, and dioctylbutyl phosphate; citric acid esters such as acetyltributyl citrate; benzoic acid esters such as octyl benzoate; alkyl amides such as diethyllauryl amide; aliphatic acid esters such as dibutoxyethyl succinate and diethyl azelate, trimesic acid esters such as tributyl trimesate; and so forth.

It is also allowed to use organic solvents each having a melting point of from about 30° C. to about 150° C., which include, for example, lower alkyl acetates such as ethyl acetate and butyl acetate; ethyl propionate; secondary butyl alcohol; methylisobutyl ketone; β-ethoxyethyl acetate; methylcellosolve acetate; and solvents readily be soluble in or water, such as a lower alcohol.

A preferably applicable proportion of the dyestuffs to the high-boiling solvents used therein is at 10:1 to 1:10 by weight.

The dyestuffs and other additives may also be added in the form of a filling polymer latex composition into an emulsion or the like. The polymer latexes used therein include, for example, a polyurethane polymer, a polymer polymerized with a vinyl monomer and so forth.

A preferably applicable proportion of the dyestuffs to the polymer latexes used therein is at 10:1 to 1:10 by weight.

Such dyestuffs may be localized in a specific layer in such a manner that a hydrophilic polymer having an opposite charge is made coexist as a mordant in the layer and is then made interact with the dyestuff molecules.

The polymer mordants are a polymer having a portion of a nitrogen-containing heterocyclic ring containing a secondary and tertiary amino groups, and a polymer containing the quaternary cationic group thereof. Such mordants have a molecular weight of, preferably, not less than 5000 and more preferably not less than 10000.

These mordants include, for example, a vinylpyridine polymer and a vinylpyridinium cationic polymer; a vinyl-imidazolium cationic polymer; a polymer mordant capable of cross-linking to gelatin or the like; an aqueous sol type mordant; a water-insoluble mordant; a reactive mordant capable of covalent-bonding to a dyestuff; a polymer induced from an ethylene-unsaturated compound having a dialkylaminoalkyl ester residual group:a product produced through a reaction of a polyvinylalkyl ketone with an aminoguanidine; a polymer induced from a 2-methyl-1-vinylimidazole; and so forth. Further, such a dyestuff may be dissolved with a surface active agent.

As for the useful surface active agents, they may also be an oligomer or a polymer.

In stead of the above-mentioned high-boiling solvents or using the high-boiling solvent in combination, a hydrophilic polymer may be used. A microcapsulation method may be applied, in which a polymer having a carboxyl group, a sulfonic acid group or the like at the side chain thereof.

It is also allowed to contain the hydrosol of a lipophilic polymers in the resulting hydrophilic colloidal dispersion.

As for the dyestuffs preferably used in the light sensitive materials of the invention, which is made decolorant in or effluent from a developing process, there are various compounds well-known as an anti-halation dyestuff or an anti-irradiation dyestuffs including, for example, the following compounds having the formulas and the maximum absorption wavelengths when they are in the form of aqueous solutions. It is, however, to be understood that the compounds used in the invention shall not be limited to the compounds hereby exemplified.

(Exemplified compounds)

A

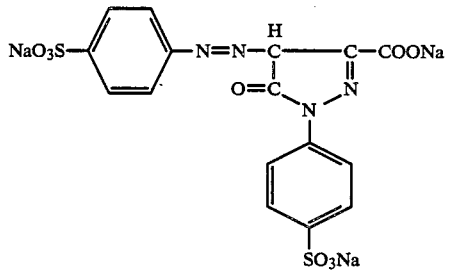

$H_2O$
λmax(nm)
430

B

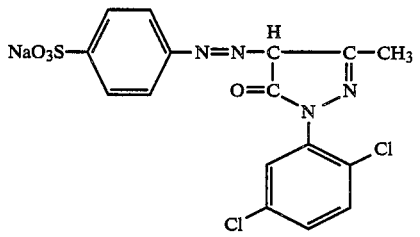

402

C

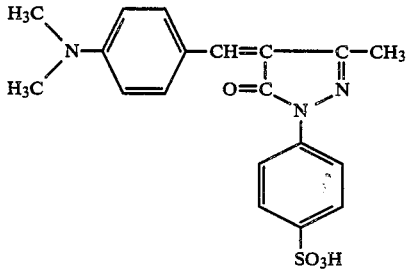

510

-continued
D
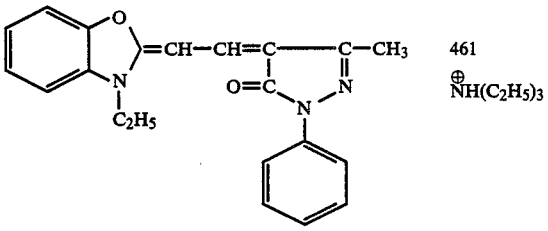
461
E
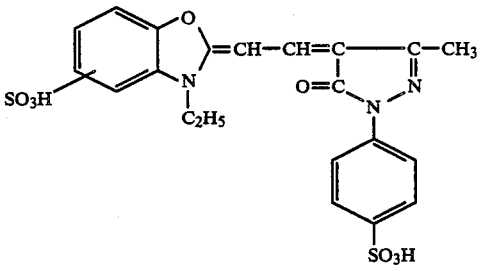
450
F
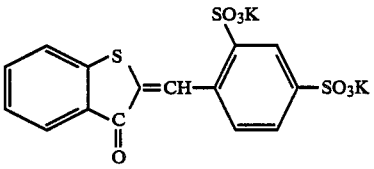
445
G
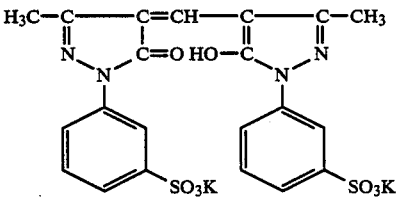
415
H
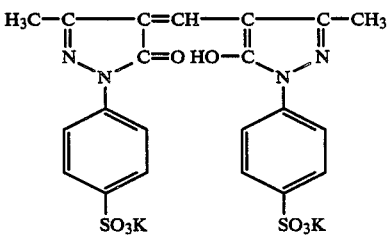
420
I
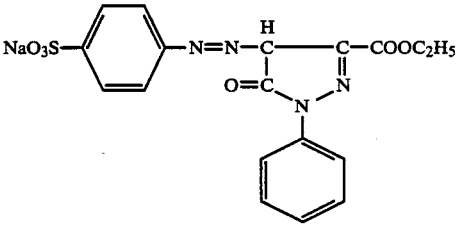
480

-continued
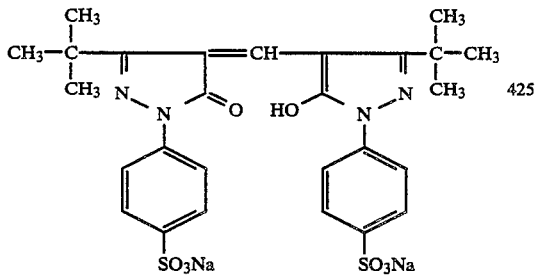
425 J
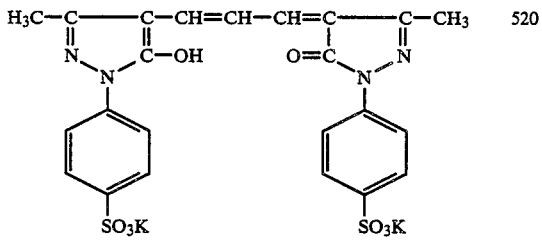
520 K
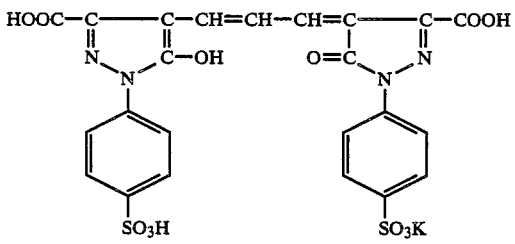
545 L
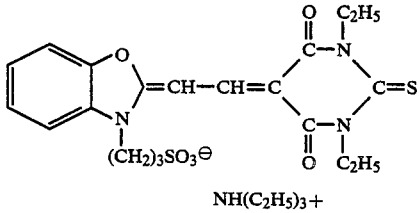
459 M
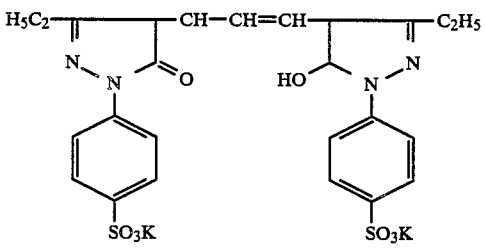
558 N
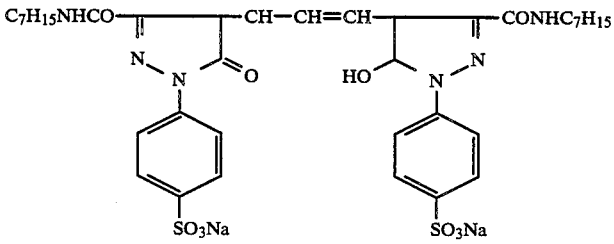
545 O -continued

P

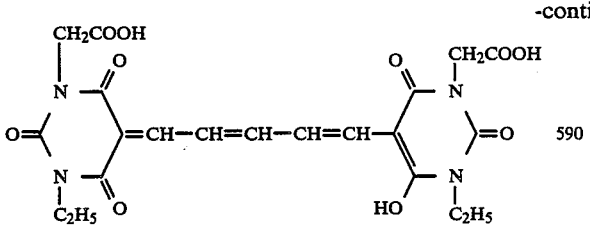

590

Q

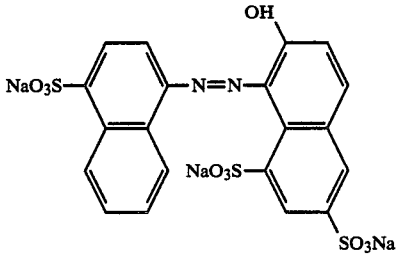

508

R

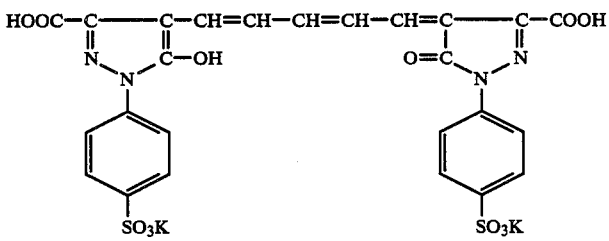

637

S

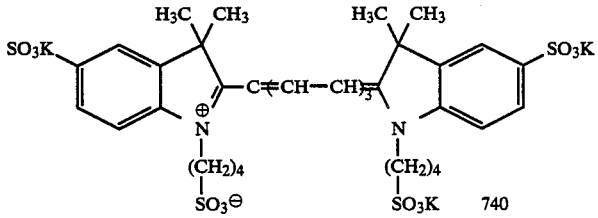

740

T

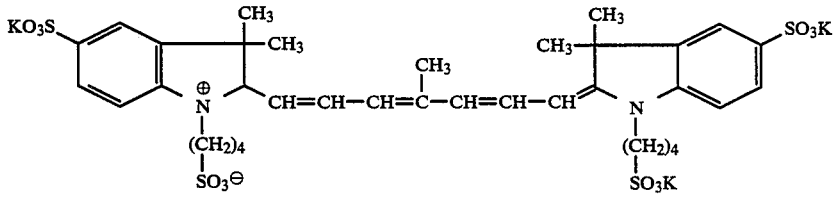

765

The particularly preferable compounds among the above-given dyestuff compounds may be given those each having the following formula [I]:

Formula [I]

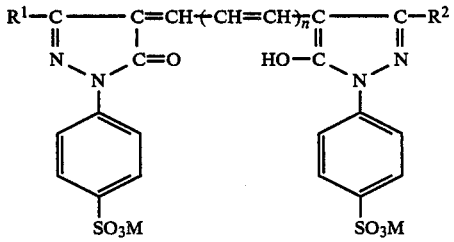

wherein $R^1$ and $R^2$ are each an alkyl group having 1 to 7 carbon atoms, a carboxyl group, an alkoxycarbonyl group, an alkylaminocarbonyl group, an amino group, an acylamino group or a trifluoromethyl group; M is a hydrogen atom, an alkali-metal atom or an ammonium group; and n is an integer of 0,1 or 2.

The above-exemplified compounds may be synthesized in the methods such as described in British Patent No. 560,385; U.S. Pat. No. 1,884,035; Japanese Patent Examined Publication No. 22069-1964; and so forth.

The typical examples of the dyestuffs mentioned above and other useful compounds are disclosed in West German Patent No. 616,007, British Patent Nos. 584,609 and 1,177,429; Japanese Patent Examined Publication Nos. 7777-1951, 22069-1964 and 38129-1979; Japanese Patent O.P.I. Publication Nos. 85120-1973, 99620-1974, 114420-1974, 129537-1974, 28817-1975, 108115-1977 and 185038-1982; U.S. Pat. Nos. 1,878,961, 1,884,035, 1,912,797, 2,098,891, 2,150,695, 2,274,782, 2,298,731, 2,409,612, 2,461,484, 2,527,583, 2,533,472, 2,865,752, 2,956,879, 3,094,418, 3,125,448, 3,148,187, 3,177,078, 3,247,127, 3,260,601, 3,282,699, 3,409,433, 3,540,887, 3,575,704, 3,653,905, 3,718,472, 3,865,817, 4,070,352 and 4,071,312; PB Report No. 74175; Photo. Abs., 1 28 ('21); and so forth.

These dyestuffs may be added to any photographic component layers of a light-sensitive material. Namely, they may be added to at least one of the component layers including, for example, light-sensitive emulsion layers, other hydrophilic colloidal layers which are non-light-sensitive layers such as interlayers, a protective layer or a subbing layer each arranged to the side of the emulsion layers coated. The dyestuffs are contained preferably in silver halide emulsion layers or the layers closer to the support of the light-sensitive material than the emulsion layers, or in the both layers. To be more effective, it is further preferable to contain them in a coated layer arranged face to face to the transparent support of the light-sensitive material. It is preferred that such dyestuffs are contained as closer as possible and the dyestuf contents are as large as possible.

The amount of the dyestuffs added is preferably from 0.2 $mg/m^2$ to 20 $mg/m^2$ and more preferably from 0.8 $mg/m^2$ to 15 $mg/m^2$.

Such a dyestuf as mentioned above may be introduced into a hydrophilic colloidal layer in an ordinary method. Namely, the dyestuff is dissolved to make an aqueous solution having a suitable concentration and, when an emulsion layer is colored, the aqueous dyestuff solution is added into a silver halide emulsion before coating the silver halide emulsion. Otherwise, the aqueous resulting dyestuff solution is added into an aqueous hydrophilic colloidal solution. Then, the resulting solutions may be coated, directly or through the other hydrophilic colloidal layers, to a support in a variety of coating methods.

The time of adding such an aqueous dyestuff solution may be any time during the preparation of a light-sensitive material. However, it is preferred to add it immediately before coating, from the viewpoint of preparatory convenience.

With the purpose of improving the dimensional stability and other properties of photographic component layers and other hydrophilic colloidal layers, light-sensitive materials of the invention are allowed to contain arbitrarily any of the dispersions of water-insoluble or hardly soluble synthetic polymers.

If required, a variety of additives such as a development accelerator, an optical brightening agent, a UV absorber and so forth may be used in the light-sensitive materials of the invntion.

In the light-sensitive materials of the invention, the photographic emulsion layers and other layers thereof may be embodied by coating them over to one or both sides of any support which is usually applied to photographic light-sensitive materials. For coating them, there are available any methods such as a dip-coating method, a roller coating method, a curtain coating method, an extrusion coating method and so forth.

As for the automatic processors relating to the invention by which it is taken for 20 to 60 seconds to process light-sensitive materials, there is no special limitation to the types thereof, however, a roller transport type, a belt conveyor type and so forth may be used. Among them, the roller transport type may be used preferably.

An example of the automatic processing apparatuses preferably used as the automatic processors relating to the invention is shown in FIG. 1 attached hereto. When using this automatic processing apparatus to process lightsensitive materials, about 500 sheets of 10"×12" sized film can be processed every hour, in spite of its compact size of not larger than about 800 mm each in the dimensions (height, width and depth). Further, this apparatus can be incorporated with two units of built-in type replenishing tanks each having a capacity of about 25 liters so that the dimensions may be limited to about 1200×800×800 mm in size.

The construction of this example of the automatic processor shown in FIG. 1 is as follows.

This apparatus is shielded with housing 20 against outside light. To the left side of housing 20, film insert table 1 is provided to supply an unprocessed light-sensitive material into the apparatus and, to the right side thereof, film basket 2 is provided to deliver a processed lightsensitive material from the apparatus, respectively.

Figure 2:
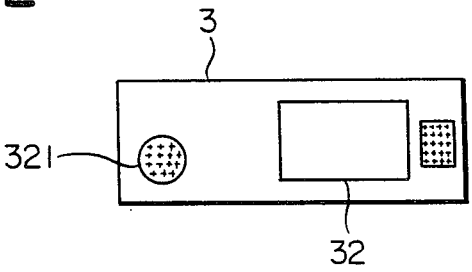
FIG. 2 shows the front view of the operation panel of the apparatus shown in FIG. 1.

To the upper front of housing 20, operation panel 3 is provided. Panel 3 is attached with an operating switch and an indicator necessary for operation. When operating this switch, a conversation type display 32 (See FIG. 2) on operation panel 3 indicates an operation start or stop, a temperature setting, a display of a processing temperature or of a trouble and so forth. In addition to the above, a voice conversation type display may also be embodied. In this operating method, a separate type remote control box (not shown) is provided, besides remote control receiver 31. Therefore, a remote control can be made in emergency from a surgical operation room, for example, so that an immediate action can be taken by this remote control.

When controlling a processing liquid level, the scattering of processing time may be avoided and the processability of a light-sensitive material may also be controlled. Besides, the above, with the purpose of avoiding the variations of voltage and loads as well as avoiding the processing time scattering, a suitable drive motor is so selected as not to cause any scattering in the constant drive speed of the aforementioned transport roller 4. Further, a variable drive speed control may be devised to perform with a single action, or an automatic drive speed control may also be devised to perform by automatically sensing every kind of light-sensitive materials. In either cases, a drive speed changed once may be kept constant.

A film width sensing means (not shown) is provided to film feed inlet 1*a* of film insert table 1, so that the width of every light-sensitive material being inserted may be discriminated so as to output the information to a control section. In the control section, the area of the light-sensitive material is computed to make a criterion of replenishing a processing liquid.

In housing 20, both film width sensing means provided close by film feed inlet 1*a* and the control section are arranged separately from each other and, therefore, the two of these are connected with an electric wire. Between the two of these, however, there is a large capacity of load such as a heater and so forth and there may be some instances where an electric noise or the like is generated by the load so as to transmit a wrong information. If this is the case, an optical fiber may effectively be utilized as a connecting means.

In developer tank 6, fixer tank 7 and washer tank 8, there are provided with the thermostat tanks, respectively. These thermostat tanks are made of moldings and each thermostat tank may be united into a body with the respective processing tanks. It is allowed to form these thermostat tanks so as not to leave any remaining liquid when draining, if the shapes of the thermostant tanks may carefully be designed. Such thermostat tanks each have a temperature sensor for sensing a temperature of a thermally controlled processing liquid. The temperature sensors used therein include, for example, a thermistor, a platinum sensor and a silicon sensor. An information sent from the temperature sensor is inputted to a temperature control senction to control every liquid to the respectively suitable temperatures.

In drying section 9, not only a temperature information but also a humidity information are inputted so as to control a heater and a fan to keep a suitable drying conditions according to a temperature, a humidity, an airflow and so forth. This control mechanism may also be applied to various drying means. In the drawing, reference numeral 91 is a squeezing section and 92 is a drying means section.

Every liquid of developer tank 6, fixer tank 7 and washer tank 8 are drained through cock 22 which is provided to the wall of housing 20 so as to be readily handled.

The automatic processor is connected to various attachments such as a film supplier by which sheet type light-sensitive materials are supplied one after another. As for the interfaces for the above-mentioned attachments, an optical fiber is also utilized from the viewpoint of noise protection. A system may also be integrated into a body by supplying electric power to the attachments.

The control system of automatic processors may also be provided with a microcomputer and thereby a computation of replenishing processing liquids, a temperature control, a driving control and so forth may be performed. In checking up these data, inputs, a driving system and so forth, the maintenance efficiency may be improved by making use of a hand-held computer.

In the above-mentioned automatic processor, rubber-made rollers may preferably be used. As for the materials of such rollers, a silicone rubber or an ethylene-propylene rubber such as EPDM may preferably be used, for example.

When making use of such automatic processor, an excellent transportability and image quality may be maintained even in a wide range where a roller surface coarseness, Rmax is from 0.1 to 100 μm. As compared to the conventional types of automatic processors in which the transportability and image quality are maintained by setting the Rmax thereof in the range of from 1 to 15 μm, the above-mentioned automatic processors are remarkably advantageous. (The coarseness, Rmax, is specified in Japanese Industrial Standard JIS B-0601).

In the above-mentioned automatic processors, the numbers of the rollers such as rubber rollers are usually one to 8 rollers in a developing section. In these processors, there is not so much influence found on image quality even when the hardness of rubber rollers used is increased by 30 degrees, for example. When making use of a rubber roller having a hardness of 30 degrees, there is no bad influence found even when the hardness is increased to 60 degrees by a variation with the passage of time. In the case that the processor is of the conventional type, an image quality variation is found when the variation range of hardness is about 10 degrees or more.

As compared to such a conventional type processors, there is neither variation in hardness nor hindrance but a freedom even if a hardness distribution is substantially wide and, further, there is almost no problem even if the hardness distribution is scattered. The hardness is in accordance with the rubber hardness specified in JIS K-6301.

Further, the interval distance between films, a distance between the trailing end of a film inserted previously and the leading end of another film inserted thereafter, can be shortened to be 5 to 80 mm, conventionally, 40 mm at shortest. A further rapid processing can be performed. More numbers of sheets can be processed. The processing capacity can be improved by 20% at maximum as compared with the concentional type processors.

Also, the total number of rollers can be reduced. For example, about 20 rollers can be reduced as compared with a conventional processor having the same processing capacity. For example, a conventional processor has 110 rollers, while this processor has 85 rollers. A ratio of the numbers of opposite rollers to the total number of rollers can be increased to be within the range of from 0.5 to 1.0, conventionally, about 0.45. Thereby, a processing time can be shortened and image quality can also be maintained.

Regarding the quantity of each processing liquid replenished, in the conventional processors, the developer replenishment is 33 cc (+10%, −0%) per 10×12 sized sheet, and the fixer replenishment is 63 cc (+10%, −0%) per 10″×12″ sized sheet, while in the above-mentioned processor, the developer replenishment is from 5 to 40 cc per 10″×12″ sized sheet and the fixer replenishment id from 10 to 70 cc per 10″×12″ sized sheet and the processability and image quality can be maintained and a small quantity replenishment can be achieved. Regarding the washing water, the conventional processors requires 1.5 to 5 liter of water per minute, while the above-mentioned processor requires 0.5 to 3.0 liter per minute to maintain the processability and image quality.

Besides the above, in the above-mentioned processor, there is few scum or contamination ocurred even without any fixer filter and it is also possible to make then occur at all. The conventional processors have both developer filter and fixer filter.

Regarding the drying property, in the above-mentioned processor, a sufficient drying property can be maintained with the drying airflow of from 6 to 14 $m^3$ per minute and the heater capacity of from 2 to 4 kW at 200 V. In the conventional processors require the airflow of about 14 $m^3$ per minute and the heater capacity of 3.5 kW.

EXAMPLES

Now, the examples of the invention will be described in detail. It is, however, the matter of course that the invention shall not be limited to the following examples.

EXAMPLE-1

There prepared a monodisperse cubic silver iodobrimide emulsion containing 2.0 mol % silver iodide having an average grain size of 0.20 μm by controlling a temperature, pAg and pH to be 60° C., 8.0 and 2.0, respectively, in a double-jet method. Taking a part of this emulsion to serve as a core, the grains were grown up as follows. Namely, a solution containing the core grains and gelatin was added to 40° C., pAg 7.0 and pH 9.5 with both of an ammoniacal silver nitrate solution and a solution containing potassium iodide and potassium bromide in a double-jet method, so that the primary coated layer containing 30 mol % silver iodide was formed on the core grains. An ammoniacal silver nitrate solution and a potassium bromide solution were then added at pAg=9.0 and pH=9.0 in a double-jet method, so that the secondary coated layer was formed on the primary coated layer. Thus, a mono-disperse cubic silver iodobromide emulsion was prepared.

The emulsion grains were made to be 1.0 μm, 0.6 μm and 0.5 μm in the three sizes in total. These three sizes of the grains were mixed up and used. Besides, the grains having the iodide contents of 2.5 mol % and 5.5 mol % were obtained by every grain size, respectively. Further, the grains having the surface iodide contents of 0.6 mol %, 0.4 mol % and 0.1 mol % were obtained by every grain size, respectively.

The resulted emulsions were added by the grain sizes with the following spectral sensitizing dyes A and B in the amounts given below:

| Grain size | Spectral sensitizing dye A | Spectral sensitizing dye B |
|---|---|---|
| 1.0 μm | 270 mg/Ag × mol | 12 mg/Ag × mol |
| 0.6 μm | 450 mg/Ag × mol | 20 mg/Ag × mol |
| 0.5 μm | 540 mg/Ag × mol | 24 mg/Ag × mol |

Spectral sensitizing dye A

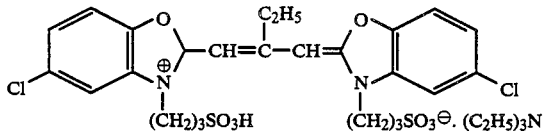

Spectral sensitizing dye B

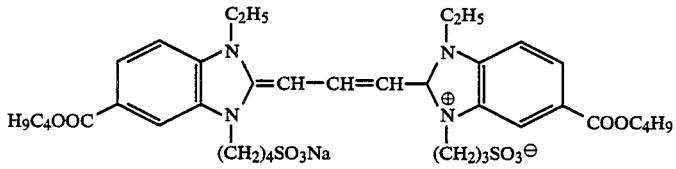

Next, the resulted emulsions each containing the above-mentioned spectral sensitizing dyes A and B were added with gold thiocyanate and ammonium thiosulfate and were then suitably gold-sulfur sensitized. The sensitized emulsions were stabilized by 4-hydroxy-6-methyl-1,3,3*a*,7-tetrazaindene and the gelatin contents of the emulsions were adjusted as shown in Table-1.

The gold-sulfur sensitized emulsions having the grain sizes of 1.0 μm, 0.6 μm, and 0.5 μm were mixed up with each other in the weight ratio of 25:40:35, respectively. The average grain size of the mixed emulsion was 0.665 μm. The grains were mixed up, for example, in the following manner.

With respect to Emulsions Type A, those having the same iodide content of 2.5 mol % in each grain, the same iodide content of 0.1 mol % on each surface and the above-mentioned three different kinds of average grain sizes were mixed up in the ratio of 25:40:35, respectively.

| Emulsion type | Iodide content in grain (mol %) | Iodide content in grain surface (mol %) | Grain size (μm) | Ratio |
|---|---|---|---|---|
| A | 2.5 | 0.1 | 1.0, 0.6, 0.5 | 25:40:35 |
| B | 2.5 | 0.4 | 1.0, 0.6, 0.5 | 25:40:35 |
| C | 2.5 | 0.6 | 1.0, 0.6, 0.5 | 25:40:35 |
| D | 5.5 | 0.1 | 1.0, 0.6, 0.5 | 25:40:35 |

Further, the following additives were added to the emulsions and the solutions for protective layers, respectively. Still further, the protective layer solutions were added with the hardeners given in Table-1 so as to be the swelling values shown in Table-1, respectively.

The names and amounts of the additives added per mol of silver halides to the emulsions were 400 mg of t-butyl-catechol; 1.0 g of polyvinyl pyrolidone (having molecular weight of 10,000); 2.5 g of styrene-anhydrous maleic acid copolymer; 10 g of trimethylol propane; 5 g of diethylene glycol; 50 mg of nitrophenyl-triphenylphosphonium chloride; 4 g of ammonium 1,3-dihydroxybenzene-sulfonate; 15 mg of sodium 2-mercaptobenzimidazole-5-sulfonate; 70 mg of

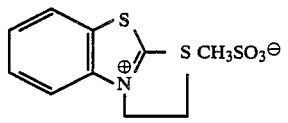

1 g of $nC_4H_9OCH_2CH(OH)CH_2N(CH_2COOH)_2$ ;

bromo-1-nitromethane; and so forth.

As for the protective layer solutions, the following solutions a and b were prepared.

Protective layer solution - a:

This solution has the following composition. The amount added is expressed by an amount added per liter of a coating liquid used.

| | |
|---|---|
| Lime-processed inert gelatin | 68 g |
| Acid-processed gelatin | 2 g |
| $NaO_3S—CH(CH_2COOC_{10}H_{21})—COOC_5H_{11}$ (Coating assistant) | 1 g |
| Polymethyl methacrylate, a matting agent having average grain size by area of 3.5 μm | 1.1 g |
| Silicon dioxide grains, a matting agent having average grain size by area of 1.2 μm | 0.5 g |

-continued

| | |
|---|---|
| Ludox AM (made by DuPont), colloidal silica | 30 g |
| A 2% aqueous solution of 2-4-dichloro-6-hydroxy-1,3,5-triazine, a hardener | 10 ml |
| A 35% formalin solution, a hardner | 2 ml |
| A 40% aqueous glyoxal solution, a hardener | 1.5 ml |
| 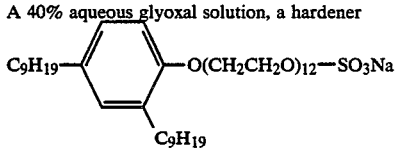 | 1.0 g |
| 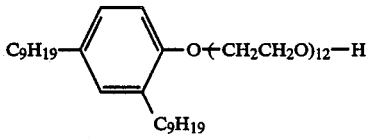 | 0.4 g* |
| $CH_2COO(CH_2)_9CH_3$<br>\|<br>$CHCOO(CH_2)_2CH(CH_3)_2$<br>\|<br>$SO_3Na$ | 0.3 g |
| 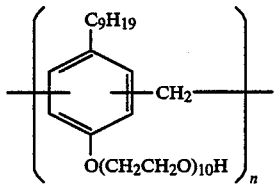 <br>(n is a mixture of 2 to 5) | 2.5 g* |
| $NaO_3S—CH—COOCH_2(C_2F_4)_3H$<br>\|<br>$CH_2COOCH_2(C_2F_4)_3H$ | 0.5 g |
| $F_{19}C_9—O(CH_2CH_2O)_{10}—CH_2CH_2—OH$ | 3 mg* |
| $C_4F_9SO_3K$ | 2 mg |

Protective layer solution - b:

Protective layer solution - b was prepared by removing the chemicals marked by asterisks * from the composition of the above-mentioned protective layer solution - a.

The undermentioned samples were prepared by coating the aforementioned two kinds of protective layer solutions, respectively. The protective layer solution - a contained a nonionic surface active agent, but the solution b did not contain any ionic surface active agent.

The above-mentioned emulsions and the protetive layer solutions having the gelatin contents shown in Table-1 were simultaneously multicoated at a coating rate of 60 meters per minute over to the both sides of subbed polyester film supports in a slide-hopper method, in the order of silver halide emulsion layers (a viscosity and surface tension of the coating solution were 18 cp and 35 dyn/cm, respectively, and coated layer thickness of 50 μm) and protective layers (a viscosity and, surface tension of the coating solution were 11 cp and 26 dyn/cm, respectively and coated layer thickness of 17 μm), respectively, so that Samples No. 1 through No. 18 were prepared. The amounts of silver coated to either sides were 2.5 g/m$^2$ and 3.4 g/m$^2$ each per one side of the support.

The sensitometry of the resulted samples were carried out as follows.

A sample was sandwiched between two pieces of optical wedges of which density gradients were so adjusted to be mirrorwise symmetrical and was then exposed to a light source having a color temperature of 5,400° K. from both sides at the same time, in the same quantity of light and for 1/12.5 of a second.

The process was carried out in the following steps with a roller-transport type automatic processor shown in FIG. 1, which takes 45 seconds to complete the whole of processing steps.

| | Processing temperature | Processing time |
|---|---|---|
| Inserting | — | 1.2 sec |
| Developing + cross-over | 35° C. | 14.6 sec |
| Fixing + cross-over | 33° C. | 8.2 sec |
| Washing + cross-over | 25° C. | 7.2 sec |
| Squeezing | 40° C. | 5.7 sec |
| Drying | 45° C. | 8.1 sec |
| Total: | — | 4.0 sec |

The construction of the automatic processor shown in FIG. 1 was as mentioned before. Particularly in this example, however, the processor having the following features was used.

In this example, rubber rollers were used. Among the rubber rollers, those used in cross-over sections were made of silicone rubber having a hardness of 48 degrees and those used in processing liquid tanks were made of EPDM that is one of ethylene-propylene rubbers having a hardness of 46 degrees. The coarseness of the roller surfaces were Dmax=4 μm and the numbers of the rollers were 6 rollers in the developing section and 84 rollers in total. The numbers of the opposed rollers were 51 and the ratio of the numbers of opposed rollers to the numbers of total rollers was 51/84=0.61. The amount of developer replenished was 30 cc per 10"×12" sized sheet, the amount of fixer replenished was 60 cc per 10"×x 12" sheet and the amount of washing water used was 1.5 liter per minute. The airflow of the drying section was 11 m$^2$ per minute and the capacity of heater was 3 kW (200 V).

The total processing time was 45 seconds as mentioned above.

The developer used was the aforementioned Developer-I containing glutaraldehyde and the fixer used was the fixer XF manufactured by Konishiroku Photo Ind. Co., Ltd.

From the resulted characteristic curves of each samples, the amounts of exposure at the density of base density+fog density+1.0 were obtained and the relative sensitivities were also obtained.

With respect to each samples, the line speed of the above-mentioned 45 second processable automatic processor was slowed down by a half and then the sensitivities in terms of the conventional processing rate of 90 seconds were also obtained.

The drying property of each samples were further evaluated in the following manner. Namely, the above-mentioned 45 second automatic process was carried out and the samples passed through the drying section were evaluated generally about the touch, the degrees of the adhesion to other samples and so forth. The results thereof are graded by 5 ranks from 1, poor, to 5, excellent. If a sample is ranged as from 3 to 5, the samples may have no problem, but if ranked as 1 or 2, such a sample cannot practically be used.

Besides, the roller-marks were evaluated in such a manner that the 45 second automatic process was carried out and, at the density of 1.0, the degree of the density irregularity i.e., the roller-mark caused by the roughness of the rollers was visually evaluated. The results thereof are grades by 5 ranks from 1, poor, to 5, excellent. If a sample is ranged as from 3 to 5, the sample may have no problem, but if ranked as 1 or 2, such a sample cannot practically be used.

The test of the tone variations caused by a silver content was tried in such a manner that, in the same manner as in the above-mentioned sensitometry, a sample exposed and processed was allowed to stand for a day long under the circumstances at 60° C. and 80% RH and then the variation of silver tone was evaluated visually. The results thereof are graded by 5 ranks from 1, poor, to 5, excellent. If a sample is ranged as from 3 to 5, the sample may have no problem, but if ranked as 1 or 2, the sample cannot practically be used.

The results from the above-mentioned evaluations are shown in Table-1.

It is found from Table-1 that the samples relating to the invention are excellent in both density and drying property and less in roller-mark and further suitable for super-rapid processing, even when they are processed in the 45 second processing.

As compared with the conventional 90 second processing and especially with Sample No. 1 having a high gelatin content, it is also found that the processing time can be shortened by one half and the processing capability can be doubled, in spite of the sensitivity is still more than equivalent to that of Sample No. 1.

TABLE 1

| Iodide Content of grain Surface mol % | Sensitivity 90 sec. process | Sensitivity 45 sec. process | Drying grade | Roller-mark grade | Sepia tone grade | Inv. or not |
|---|---|---|---|---|---|---|
| 0.1 | 100 | 60 | 1 | 2 | 2 | Not inv. |
| 0.1 | 120 | 100 | 3 | 3 | 3 | Inv. |
| 0.1 | 150 | 130 | 5 | 5 | 5 | Inv. |
| 0.1 | 151 | 132 | 5 | 5 | 4 | Inv. |
| 0.1 | 149 | 129 | 5 | 5 | 4 | Inv. |
| 0.1 | 166 | 149 | 5 | 4 | 3 | Inv. |
| 0.1 | 170 | 155 | 4 | 3 | 4 | Inv. |
| 0.1 | 100 | 65 | 3 | 4 | 3 | Not inv. |
| 0.1 | 160 | 142 | 4 | 4 | 4 | Inv. |
| 0.1 | 152 | 133 | 4 | 4 | 4 | Inv. |
| 0.1 | 158 | 144 | 2 | 2 | 2 | Inv. |
| 0.1 | 152 | 138 | 4 | 4 | 3 | Inv. |
| 0.1 | 145 | 132 | 5 | 5 | 4 | Inv. |
| 0.1 | 92 | 70 | 3 | 3 | 3 | Inv. |
| 0.1 | 140 | 120 | 4 | 4 | 1 | Not inv. |
| 0.6 | 130 | 100 | 4 | 2 | 1 | Not inv. |
| 0.4 | 137 | 109 | 4 | 4 | 4 | Inv. |
| 0.1 | 140 | 120 | 4 | 3 | 3 | Not inv. |

EXAMPLE-2

Ten (10) grams of the aforegiven exemplified dyestuff No. 11 were weighed to take out and were then dissolved in a solvent of 10 cc of tricresyl phosphate and 20 cc of ethyl acetate. The resulted solution was dispersed to be emulsified in 100 cc of a 15% aqueous gelatin solution containing 750 mg of an anionic surface active agent, so that a dyestuff solution A was prepared.

Five (5) grams each of dyestuffs No. 2 and No. 3 were weighed to take out and were then dissolved in a solvent of 170 cc of tricresyl phosphate and 170 cc of ethyl acetate. The resulted solution was then dispersed to be emulsified in 1000 cc of a 15% aqueous gelatin solution containing 3.5 g of an anionic surface active agent, so that a dyestuff solution B was prepared.

Further, two (2) grams of the aforegiven exemplified dyestuff N were weighted to take out and were then dissolved in water, so that dyestuff solution C was prepared.

The resulted dyestuff solutions were added into Emulsions A, B and C each used in Example-1, as shown in Table-2.

The protective layers used and the coating method applied were the same as in Example-1.

With the resulted samples, the sensitivities, drying properties, roller-marks and sepia tone variations thereof were checked up in the same manners as in Example-1, and the results thereof are shown in Table-2.

As shown in Table-2, it is found that, when adding dyestuffs, the effects of the invention can further remarkably be displayed, excellent in drying properties, and less in both roller-marks and the variation of silver tones.

TABLE 2

| Sensitivity 90 sec. process | Sensitivity 45 sec. process | Drying grade | Roller-mark grades | Sepia tone grade | Inv. or not |
|---|---|---|---|---|---|
| 90 | 52 | 1 | 4 | 3 | Not inv. |
| 90 | 56 | 1 | 4 | 2 | Not inv. |
| 99 | 57 | 1 | 4 | 2 | Not inv. |
| 140 | 120 | 4 | 5 | 5 | Inv. |
| 130 | 118 | 5 | 5 | 5 | Inv. |
| 133 | 119 | 5 | 5 | 5 | Inv. |
| 92 | 58 | 4 | 4 | 2 | Not inv. |
| 160 | 140 | 3 | 3 | 3 | Inv. |
| 145 | 129 | 4 | 1 | 2 | Inv. |
| 140 | 120 | 4 | 2 | 2 | Inv. |
| 160 | 130 | 4 | 4 | 4 | Inv. |
| 90 | 50 | 4 | 4 | 4 | Inv. |

As described above, the silver halide photographic light-sensitive materials of the invention can display the effects that the sensitivity and drying property are excellent and roller-marks and silver tone variations can be produced very few, even if the gelatin contents are reduced to the lower limit where a super-rapid processing may be performed within the whole processing period of time from 20 to 60 seconds.

EXAMPLE-3

Seventeen kinds of samples of the photographic materials, Nos. 101 to 117, were prepared using Emulsion Type-A and Protective Layer-a (as used in Example 1). Among these samples, Nos. 101, 107, 111, 112 and 117 were comparative samples, and the others were samples prepared according to the invention. The preparation of the samples was performed in the manner similar to Example 1. In the samples, the gelatin content, silver halide content and swelling amount were controlled. The swelling amount was controlled by varying the amount of hardener added. As the hardener, a mixture of Hardeners (1) and (2) were used for all the samples. The samples were evaluated in the same manner as Example 1.

The values of the gelatin and silver content and the swelling amount of each sample and results of evaluation are displayed in Tables I to III. In the tables, values higher and lower than the claimed limitation are indicated by marking "+" and "−" to the right of the values, respectively. Results unacceptable for the practicle use of ultra-rapid processing are indicated by a "+" marking.

In Tables I, II and III, the comparative samples falling outside the claimed ranges were compared with the samples prepared according to the invention for each of the claimed parameters; the gelatin content, swelling amount and silver content, respectively. It is clearly shown that all of these comparative samples have at least on property unsuitable for practical ultra-rapid or 45 sec. processing use. Contrary to this, the samples of the invention were within the suitable ranges for all the evaluated properties.

TABLE I

| Sample No. | Gel. cont./side ($g/m^2$) Emulsion layer | Protect layer | Total | Swell. ($g/m^2$) | Ag cont. per side ($g/m^2$) | Sensitivity 90 sec proc. | 45 sec proc. | Drying grade | Roller mark grade | Sepia tone grade | Inv. or not |
|---|---|---|---|---|---|---|---|---|---|---|---|
| 101 | 0.8 | 0.7 | 1.5− | 40 | 2.0 | 136 | 118 | 4 | 1* | 3 | Not |
| 102 | 1.2 | 0.8 | 2.0 | 35 | 2.0 | 135 | 118 | 4 | 3 | 4 | Inv. |
| 103 | 1.9 | 0.9 | 2.8 | 40 | 2.0 | 132 | 114 | 4 | 3 | 4 | Inv. |
| 104 | 2.0 | 1.0 | 3.0 | 40 | 2.0 | 130 | 110 | 4 | 3 | 4 | Inv. |
| 105 | 2.2 | 1.1 | 3.3 | 40 | 2.0 | 123 | 101 | 4 | 3 | 3 | Inv. |
| 106 | 2.5 | 1.2 | 3.7+ | 40 | 2.0 | 107 | 79* | 2* | 3 | 3 | Not |

TABLE II

| Sample No. | Gel. cont./side ($g/m^2$) Emulsion layer | Protect layer | Total | Swell. ($g/m^2$) | Ag cont. per side ($g/m^2$) | Sensitivity 90 sec proc. | 45 sec proc. | Drying grade | Roller mark grade | Sepia tone grade | Inv. or not |
|---|---|---|---|---|---|---|---|---|---|---|---|
| 107 | 2.0 | 1.0 | 3.0 | 25− | 2.0 | 125 | 102 | 2* | 3 | 3 | Not |
| 108 | 2.0 | 1.0 | 3.0 | 30 | 2.0 | 128 | 107 | 4 | 4 | 3 | Inv. |
| 104 | 2.0 | 1.0 | 3.0 | 40 | 2.0 | 130 | 110 | 4 | 3 | 4 | Inv. |
| 109 | 2.0 | 1.0 | 3.0 | 50 | 2.0 | 135 | 117 | 3 | 3 | 4 | Inv. |
| 110 | 2.0 | 1.0 | 3.0 | 60 | 2.0 | 138 | 122 | 3 | 3 | 3 | Inv. |
| 111 | 2.0 | 1.0 | 3.0 | 65+ | 2.0 | 130 | 98* | 3 | 3 | 3 | Not |

TABLE I

| Sample No. | Gel. cont./side ($g/m^2$) Emulsion layer | Protect layer | Total | Swell. ($g/m^2$) | Ag cont. per side ($g/m^2$) | Sensitivity 90 sec proc. | 45 sec proc. | Drying grade | Roller mark grade | Sepia tone grade | Inv. or not |
|---|---|---|---|---|---|---|---|---|---|---|---|
| 112 | 2.0 | 1.0 | 3.0 | 40 | 1.0− | 120 | 90* | 3 | 3 | 2* | Not |
| 113 | 2.0 | 1.0 | 3.0 | 40 | 1.3 | 127 | 107 | 3 | 4 | 4 | Inv. |
| 114 | 2.0 | 1.0 | 3,0 | 40 | 1.5 | 129 | 109 | 4 | 4 | 4 | Inv. |
| 104 | 2.0 | 1.0 | 3.0 | 40 | 2.0 | 130 | 110 | 4 | 3 | 4 | Inv. |
| 115 | 2.0 | 1.0 | 3.0 | 40 | 2.5 | 133 | 115 | 4 | 3 | 3 | Inv. |
| 116 | 2.0 | 1.0 | 3.0 | 40 | 3.0 | 136 | 119 | 4 | 3 | 3 | Inv. |
| 117 | 2.0 | 1.0 | 3.0 | 40 | 3.5+ | 137 | 112 | 3 | 2* | 2* | Not |

What is claimed is:

1. A silver halide photographic light-sensitive material comprising a support having on at least one side thereof one or more hydrophilic layers containing gelatin, at least one of the hydrophilic layers being a light-sensitive silver halide emulsion layer, wherein the amount of said gelatin and an amount of silver halide in terms of silver contained in said hydrophilic layer or layers are each within the range of from 1.90 to 3.50 $g/m^2$ and from 1.2 to 3.2 $g/m^2$, respectively, and the swelling amount of said hydrophilc layer or layers is within the range of said 58 $g/m^2$ when said light-sensitive material is treated with a developer.

2. The silver halide photographic light-sensitive material of claim 1, wherein said photographic material is processed by an automatic processing machine in which the whole time needed for processing the photographic material is 20 sec. to 60 sec.

3. The silver halide photographic light-sensitive material of claim 1, wherein said amount of gelatin is within the range of from 2.00 $g/m^2$ to 3.30 $g/m^3$.

4. The silver halide photographic light-sensitive material of claim 1, wherein said swelling amount of said hydrophilic layer or layers is within the range of from 40 $g/m^2$ to 51 $g/m^2$.

5. The silver halide photographic light-sensitive material of claim 1, wherein an average size of silver halide grains contained in said silver halide emulsion layer is within the range of from 0.4 $\mu m$ to 2.5 $\mu m$, and at least one layer contained in said light-sensitive material contains a nonionic surface active agent.

6. The silver halide photographic light-sensitive material of claim 5, wherein said photographic material is processed by an automatic processing machine in which the whole time needed for processing the photographic material is 20 sec. to 60 sec.

7. The silver halide photographic light-sensitive material of claim 5, wherein said amount of gelatin is within the range of from 2.00 $g/m^2$ to 3.30 $g/m^2$.

8. The silver halide photographic light-sensitive material of claim 5, wherein said swelling amount of said hydrophilic layer or layers is within the range of from 40 $g/m^2$ to 51 $g/m^2$.

9. The silver halide photographic light-sensitive material of claim 5, wherein the silver iodide content in the whole silver halide grain contained in said silver halide emulsion layer and the surface of said silver halide grain is not more than 5 mol % and not less than 0.5 mol %.

10. The silver halide photographic light-sensitive material of claim 5, wherein an amount of said nonionic surface active agent in said light-sensitive material is 1 $mg/m^2$ to 500 $mg/m^2$.

11. The silver halide photographic light-sensitive material of claim 5, wherein at least one of said hydrophilic layer contains a dye.

12. The silver halide photographic light-sensitive material of claim 11, wherein said dye has a light absorption maximum within the range of from 520 nm to 580 nm and is capable of remaining after processing in the layer in which said dye is added.

13. The silver halide photographic light-sensitive material of claim 11, wherein said dye is capable of decoloring or flowing away from the light-sensitive material during the processing thereof.

14. A process for processing a silver halide photographic light-sensitive material by an automatic processor in which the whole time for processing said light-sensitive material is within the range of from 20 sec. to 60 sec., wherein said light-sensitive material comprises a support having on at least one side thereof one or more hydrophilic layers containing gelatin, at least one of the hydrophilic layers being a light-sensitive silver halide emulsion layer, where in amount of said gelatin and an amount of silver halide in terms of silver contained in said hydrophilic layer or layers are each within the range of from 1.90 to 3.5 g/m$^2$, and from 1.2 to 3.2 g/m$^2$, respectively, and the swelling amount of said hydrophilic layer or layers is within the range of from 30 to 50 g/m$^2$, when said light-sensitive material is treated with a developer.

15. The process of claim 14, wherein an average size of silver halide grains contained in said silver halide emulsion layer is within the range of from 0.4 μm to 2.5 μm, and at least one layer contained in said light-sensitive material contains a nonionic surface active agent.

16. The process of claim 15, wherein said amount of gelatin is within the range of form 2.00 g/m$^2$ to 3.30 g/m$^2$.

17. The process of claim 15, wherein said swelling amount of said hydrophilic layer or layers is within the range of from 40 g/m$^2$ to 51 g/m$^2$.

18. The process of claim 15, wherein the silver halide content in the whole silver halide grain contained in said silver halide emulsion layer and the surface of said silver halide grain is not more than 5 mol % and not less than 0.5 mol %.

19. The process of claim 15, wherein an amount of said nonionic surface active agent in said light-sensitive material is 1 mg/m$^2$ to 500 mg/m$^2$.

20. The process of claim 15, wherein at least one of said phydrophilic layer contains a dye.

21. The process of claim 20, wherein said dye has a light absorption maximum within the range of 520 nm to 580 nm and is capable of remaining after processing in the layer in which said dye is added.

22. The process of claim 20, wherein said dye is capable of decoloring or flowing away from the light-sensitive material during the processing thereof.

23. The silver halide photographic light-sensitive material of claim 1, wherein said photographic material is treated with the following developer-I for 15 sec. at 35° C.:

| Developer-I | |
|---|---|
| Potassium sulfite | 55.0 g |
| Hydroquinone | 25.0 g |
| 1-phenyl-3-pyrazolidone | 1.3 g |
| Boric acid | 10.0 g |
| Potassium hydroxide | 21.0 g |
| Triethyleneglycol | 17.5 g |
| 5-methyl-benztriazole | 0.05 g |
| 5-nitro-benzimidazole | 0.10 g |
| 1-phenyl-5-mercapto-tetrazole | 0.02 g |
| Glutaraldehyde bisulfite | 15.0 g |
| Glacial acetic acid | 16.0 g |
| Potassium bromide | 4.0 g |
| Water to make | 1 liter |

24. The process for processing a silver halide photographic light-sensitive material of claim 14, wherein said light-sensitive material is treated with the following developer-I for 15 sec. at 35° C.:

| Developer-I | |
|---|---|
| Potassium sulfite | 55.0 g |
| Hydroquinone | 25.0 g |
| 1-phenyl-3-pyrazolidone | 1.3 g |
| Boric acid | 10.0 g |
| Potassium hydroxide | 21.0 g |
| Triethyleneglycol | 17.5 g |
| 5-methyl-benztriazole | 0.05 g |
| 5-nitro-benzimidazole | 0.10 g |
| 1-phenyl-5-mercapto-tetrazole | 0.02 g |
| Glutaraldehyde bisulfite | 15.0 g |
| Glacial acetic acid | 16.0 g |
| Potassium bromide | 4.0 g |
| Water to make | 1 liter |

* * * * *

UNITED STATES PATENT AND TRADEMARK OFFICE

CERTIFICATE OF CORRECTION

PATENT NO. : 4,861,702

DATED : August 29, 1989

INVENTOR(S) : Akio Suzuki et al.

It is certified that error appears in the above-identified patent and that said Letters Patent is hereby corrected as shown below:

In The Title, Page 1, change "PROCESSING" to --PROCESSABLE--.

Claim 1, Column 33, Line 52, change "said" to --from 30 to--.

Claim 14, Column 35, Line 19, change "50" to --58--.

Claim 16, Column 35, Line 27, change "form" to --from--.

Signed and Sealed this

Twenty-sixth Day of February, 1991

*Attest:*

HARRY F. MANBECK, JR.

*Attesting Officer*

*Commissioner of Patents and Trademarks*

UNITED STATES PATENT AND TRADEMARK OFFICE
CERTIFICATE OF CORRECTION

PATENT NO. : 4,861,702

DATED : August 29, 1989

INVENTOR(S) : Suzuki et al

It is certified that error appears in the above-identified patent and that said Letters Patent is hereby corrected as shown below:

At col. 31, lines 28 through 50, Table 1 should appear as follows:

Table 1

| Emulsion No. | Sample No. | Gelatin content per side, g/m² | | | Hardener | Swelling, g/m² | Ag content per side, g/m² | Protective layer liquid a or b | Iodide content of grain, mol% | Iodide content of grain surface mol% | Sensivitivity | | Drying grade | Roller-mark grade | Sepia tone grade | Inv. or not |
|---|---|---|---|---|---|---|---|---|---|---|---|---|---|---|---|---|
| | | Emulsion layer | Protective layer | Total content | | | | | | | 90 sec. process | 45 sec. process | | | | |
| A | 1 | 2.40 | 1.20 | 3.60 | (1) | 45 | 2.5 | a | 2.5 | 0.1 | 100 | 60 | 1 | 2 | 2 | Not inv. |
| A | 2 | 2.30 | 1.20 | 3.50 | (1) | 45 | 2.5 | a | 2.5 | 0.1 | 120 | 100 | 3 | 3 | 3 | Inv. |
| A | 3 | 2.20 | 1.10 | 3.30 | (1)+(2) | 45 | 2.5 | a | 2.5 | 0.1 | 150 | 130 | 5 | 5 | 5 | Inv. |
| A | 4 | 2.20 | 1.10 | 3.30 | (14) | 45 | 2.5 | a | 2.5 | 0.1 | 151 | 132 | 5 | 5 | 4 | Inv. |
| A | 5 | 2.20 | 1.10 | 3.30 | (16) | 45 | 2.5 | a | 2.5 | 0.1 | 149 | 129 | 5 | 5 | 4 | Inv. |
| A | 6 | 1.2 | 0.8 | 2.00 | (1)+(2) | 45 | 2.5 | a | 2.5 | 0.1 | 166 | 149 | 5 | 4 | 3 | Inv. |
| A | 7 | 1.1 | 0.8 | 1.90 | (1)+(2) | 45 | 2.5 | a | 2.5 | 0.1 | 170 | 155 | 4 | 3 | 4 | Inv. |
| A | 8 | 2.20 | 1.10 | 3.30 | (1)+(2) | 28 | 2.5 | a | 2.5 | 0.1 | 100 | 65 | 3 | 4 | 3 | Not inv. |
| A | 9 | 2.20 | 1.10 | 3.30 | (14) | 37 | 2.5 | a | 2.5 | 0.1 | 160 | 142 | 4 | 4 | 4 | Inv. |
| A | 10 | 2.20 | 1.10 | 3.30 | (1)+(2) | 53 | 2.5 | a | 2.5 | 0.1 | 152 | 133 | 4 | 4 | 4 | Inv. |
| A | 11 | 2.20 | 1.10 | 3.30 | (14) | 45 | 3.4 | a | 2.5 | 0.1 | 158 | 144 | 2 | 2 | 2 | Inv. |
| A | 12 | 2.20 | 1.10 | 3.30 | (16) | 45 | 3.0 | a | 2.5 | 0.1 | 152 | 138 | 4 | 4 | 3 | Inv. |
| A | 13 | 2.20 | 1.10 | 3.30 | (1)+(2) | 45 | 2.0 | a | 2.5 | 0.1 | 145 | 132 | 5 | 5 | 4 | Inv. |
| A | 14 | 2.20 | 1.10 | 3.30 | (2) | 45 | 1.1 | a | 2.5 | 0.1 | 92 | 70 | 3 | 3 | 3 | Inv. |
| A | 15 | 2.20 | 1.10 | 3.30 | (1)+(2) | 45 | 2.5 | b | 2.5 | 0.1 | 140 | 120 | 4 | 4 | 1 | Not inv. |
| C | 16 | 2.20 | 1.10 | 3.30 | (16) | 45 | 2.5 | a | 2.5 | 0.6 | 130 | 100 | 4 | 2 | 1 | Not inv. |
| B | 17 | 2.20 | 1.10 | 3.30 | (14) | 45 | 2.5 | a | 2.5 | 0.4 | 137 | 109 | 4 | 4 | 4 | Inv. |
| D | 18 | 2.20 | 1.10 | 3.30 | (1)+(2) | 45 | 2.5 | a | 5.5 | 0.1 | 140 | 120 | 4 | 3 | 3 | Not inv. |

UNITED STATES PATENT AND TRADEMARK OFFICE
CERTIFICATE OF CORRECTION

PATENT NO. : 4,861,702 Page 2 of 2

DATED : August 29, 1989

INVENTOR(S) : Suzuki et al.

It is certified that error appears in the above-identified patent and that said Letters Patent is hereby corrected as shown below:

At col. 32, lines 18 through 34, Table 2 should appear as follows:

Table 2

| Emul-sion No. | Sam-ple No. | Gelatin content per side, g/m² | | | Harde-ner | Swel-ling, g/m² | Ag content per side, g/m² | Protec-tive layer liquid a or b | Iodide content of grain, mol% | Iodide content of grain surface mol% | Dyestuff | | Sensivitivity | | Drying grade | Roller-mark grade | Sepia tone grade | Inv. or not |
|---|---|---|---|---|---|---|---|---|---|---|---|---|---|---|---|---|---|---|
| | | Emul-sion layer | Protec-tive layer | Total con-tent | | | | | | | Dye-stuff solution | Amount added, mol/m² | 90 sec. process | 45 sec. process | | | | |
| A | 19 | 2.40 | 1.20 | 3.60 | (1)+(2) | 45 | 2.5 | a | 2.5 | 0.1 | A | $2\times10^{-6}$ | 90 | 52 | 1 | 4 | 3 | Not inv. |
| A | 20 | 2.40 | 1.20 | 3.60 | (14) | 45 | 2.5 | a | 2.5 | 0.1 | B | $2\times10^{-6}$ | 90 | 56 | 1 | 4 | 2 | Not inv. |
| A | 21 | 2.40 | 1.20 | 3.60 | (16) | 45 | 2.5 | a | 2.5 | 0.1 | C | $5\times10^{-5}$ | 99 | 57 | 1 | 4 | 2 | Not inv. |
| A | 22 | 2.20 | 1.10 | 3.30 | (1)+(2) | 45 | 2.5 | a | 2.5 | 0.1 | A | $2\times10^{-6}$ | 140 | 120 | 4 | 5 | 5 | Inv. |
| A | 23 | 2.20 | 1.10 | 3.30 | (14) | 45 | 2.5 | a | 2.5 | 0.1 | B | $2\times10^{-6}$ | 130 | 118 | 5 | 5 | 5 | Inv. |
| A | 24 | 2.20 | 1.10 | 3.30 | (16) | 45 | 2.5 | a | 2.5 | 0.1 | C | $5\times10^{-5}$ | 133 | 119 | 5 | 5 | 5 | Inv. |
| A | 25 | 2.20 | 1.10 | 3.30 | (1)+(2) | 28 | 2.5 | a | 2.5 | 0.1 | C | $5\times10^{-5}$ | 92 | 58 | 4 | 4 | 2 | Not Inv. |
| A | 26 | 2.20 | 1.10 | 3.30 | (1)+(2) | 53 | 2.5 | a | 2.5 | 0.1 | B | $2\times10^{-6}$ | 160 | 140 | 3 | 3 | 3 | Inv. |
| A | 27 | 2.20 | 1.10 | 3.30 | (1)+(2) | 45 | 3.4 | a | 2.5 | 0.1 | C | $5\times10^{-5}$ | 145 | 129 | 4 | 1 | 2 | Inv. |
| A | 28 | 2.20 | 1.10 | 3.30 | (1)+(2) | 45 | 2.5 | b | 2.5 | 0.1 | A | $2\times10^{-6}$ | 140 | 120 | 4 | 2 | 2 | Inv. |
| A | 29 | 2.20 | 1.10 | 3.30 | (1)+(2) | 45 | 2.5 | a | 5.5 | 0.1 | B | $2\times10^{-6}$ | 160 | 130 | 4 | 4 | 4 | Inv. |
| D | 30 | 2.20 | 1.10 | 3.30 | (1)+(2) | 45 | 2.5 | a | 2.5 | 0.6 | A | $2\times10^{-6}$ | 90 | 50 | 4 | 4 | 4 | Inv. |

Signed and Sealed this

Twenty-second Day of June, 1993

*Attest:*

*Attesting Officer*

Michael K. Kirk

MICHAEL K. KIRK

*Acting Commissioner of Patents and Trademarks*